US007025432B2

(12) United States Patent
Yamada et al.

(10) Patent No.: US 7,025,432 B2
(45) Date of Patent: Apr. 11, 2006

(54) PRINT CONTROL BASED ON PRINT HEAD TEMPERATURE

(75) Inventors: Akitoshi Yamada, Irvine, CA (US); Hiromitsu Hirabayashi, Irvine, CA (US); Akihiko Sukigara, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/148,367

(22) Filed: Jun. 9, 2005

(65) Prior Publication Data

US 2005/0225591 A1 Oct. 13, 2005

Related U.S. Application Data

(62) Division of application No. 09/070,920, filed on May 4, 1998, now Pat. No. 6,951,378.

(51) Int. Cl.
*B41J 29/38* (2006.01)

(52) U.S. Cl. ..... 347/5; 347/17

(58) Field of Classification Search ..... None

See application file for complete search history.

(56) References Cited

U.S. PATENT DOCUMENTS

| | | | | |
|---|---|---|---|---|
| 4,664,542 A | | 5/1987 | Tsugita | 347/18 |
| 5,097,276 A | | 3/1992 | Midorikawa | 347/29 |
| 5,406,317 A | | 4/1995 | Shimamura et al. | 347/23 |
| 5,543,826 A | | 8/1996 | Kuronuma et al. | 347/23 |
| 5,552,811 A | | 9/1996 | Kurata et al. | 347/31 |
| 5,625,384 A | | 4/1997 | Numata et al. | 347/23 |
| 5,646,655 A | * | 7/1997 | Iwasaki et al. | 347/17 |
| 5,729,257 A | | 3/1998 | Sekiya et al. | 347/18 |
| 6,024,430 A | * | 2/2000 | Koitabashi et al. | 347/17 |

* cited by examiner

*Primary Examiner*—Thinh Nguyen
(74) *Attorney, Agent, or Firm*—Fitzpatrick, Cella, Harper & Scinto

(57) ABSTRACT

A method and apparatus for cooling a print head of an ink jet printer before capping includes the steps of determining an ambient temperature, determining a print head temperature, and waiting a predetermined time after receipt of the last print data for the print job, ejecting a predetermined number of ink droplets from nozzles of the print head at a frequency lower than a frequency used for printing, determining a drop in print head temperature caused by ejecting the predetermined number of ink droplets, and repeating the steps of waiting a predetermined time and ejecting a predetermined number of ink droplets until the print head temperature falls below a threshold.

28 Claims, 7 Drawing Sheets

PRINT CONTROL BASED ON PRINT HEAD TEMPERATURE

This application is a division of application Ser. No. 09/070,920, filed May 4, 1998 now U.S. Pat. No. 6,951,378.

BACKGROUND OF THE INVENTION

1. Field of the Invention

The present invention relates to controlling a print operation for an ink jet printer based on print head temperature. In particular, the invention pertains to controlling the print operation so as to cool an ink jet print head before capping.

2. Description of the Related Art

Conventional ink jet printers utilize a print head with a plurality of nozzles that are supplied with ink by internal ink supply tubes. The ink from the ink supply tubes forms a meniscus in each nozzle. A heating element is disposed behind each nozzle, and ink is ejected from a nozzle by firing the corresponding heating element. The firing of the heating element boils the ink, thereby forming a bubble of ink that is ejected from the nozzle, resulting in a dot, or pixel, on a recording medium. Thus, by controlling the firing of the heating elements, an image is formed on the recording medium.

Typically, at the conclusion of a print job or upon power-off, conventional ink jet printers move their print head (or heads) to a home position where it waits for the next print job and/or power-on. At the home position, the print head is cleaned and capped so as to protect the sensitive print head and to keep ink from drying on the outside of the print head. The capping mechanism also protects the print head from damage when servicing the printer. In addition, the capping mechanism typically includes a device for sucking ink from the print head to help keep the print head clean.

These conventional systems suffer from a problem in that the print head is often very hot when the print head is capped, resulting in hot ink being confined by the cap in the nozzles and in the ink supply tubes of the print head. In some instances, this hot ink dries out or does not form a proper meniscus in each of the nozzles of the print head due to a change in viscosity. As a result, the confined hot ink can form unwanted deposits in and on outer portions of the nozzles (i.e., beyond where the meniscus should form) and on the print head, and these ink deposits can then thicken or dry. The thickened or dried ink deposits can interfere with proper operation of the print head, resulting in poor print quality. Accordingly, it is desirable to cap the print head after the ink and the print head have cooled.

SUMMARY OF THE INVENTION

The present invention addresses the foregoing problem, following a print job, by repeatedly ejecting a predetermined number of ink droplets from nozzles of the print head at a frequency lower than a frequency used for printing, with a pause between each repetition, until a predetermined threshold is reached. Because the ink is ejected intermittently and at a frequency lower than that used for printing, the heating elements that are used to eject the ink through the nozzles do not generate sufficient heat to heat up ink in the print head. Thus, hot ink in the nozzles is ejected, and cool ink from the ink supply tubes is moved forward into the nozzles, thereby cooling both the ink and the print head itself.

Accordingly, in one aspect the invention is a method of controlling a print operation of an ink jet printer. The method includes the steps of determining a print head temperature and controlling a capping sequence based on the determined print head temperature. In the preferred embodiment, the determining step is repeated. Alternatively, the determining step is performed once before the controlling step.

In another aspect, the method of controlling a print operation of an ink jet printer includes the steps of cooling a print head using a predetermined method and capping the print head after the print head is cooled. In the preferred embodiment, the cooling step is performed by ejecting ink droplets, and the ink droplets are ejected at a frequency lower than a frequency used for printing.

In yet another aspect, the method of controlling a print operation of an ink jet printer includes the steps of printing an image using a print head and cooling the print head after the end of the printing operation using a predetermined method. Preferably, the cooling step is performed by ejecting ink droplets, with the ink droplets ejected at a frequency lower than a frequency used for printing.

In yet another aspect, the method of controlling a print operation of an ink jet printer includes the steps of obtaining a parameter corresponding to a print head temperature when the ink jet printer is down and performing a predetermined process based on the parameter. In the preferred embodiment, the parameter is obtained by a calculation, without using a measured actual temperature. Alternatively, the parameter is obtained directly from a measured actual temperature. The predetermined process occurs in a next print job performed by the ink jet printer, at a next power-on for the ink jet printer, or at an end of a current print job. The predetermined process can be determined based on whether a print head is capped or not. The predetermined process can include purging ink from the print head. In addition, the predetermined process can include changing a number of ink droplets ejected before a print job.

In yet another aspect, the invention is a method of cooling a print head of an ink jet printer before capping. The method includes the steps of determining an ambient temperature, determining a print head temperature, and waiting a predetermined time after receipt of the last print data for the print job. The method also includes the steps of ejecting a predetermined number of ink droplets from nozzles of the print head at a frequency lower than a frequency used for printing, determining a drop in print head temperature caused by ejecting the predetermined number of ink droplets, and repeating the steps of waiting a predetermined time and ejecting a predetermined number of ink droplets until the print head temperature falls below a threshold.

In the preferred embodiment, the ambient temperature is determined by using a diode disposed in the ink jet printer. In addition, the print head temperature after receipt of the last print data for the print job is determined by using a calculation based on a number of ink droplets ejected from the print head during the print job. Also in the preferred embodiment, the drop in print head temperature caused by ejecting the predetermined number of ink droplets is determined by using a calculation based on the predetermined number of ink droplets ejected and the frequency that the ink droplets are ejected from the print head. Furthermore, the predetermined time for waiting after receipt of the last print data for the print job is between nine and twelve seconds, and the predetermined number of ink droplets ejected from nozzles of the print head is thirty per nozzle. The frequency that the predetermined number of droplets are ejected from the print head preferably is approximately two kilohertz, and the frequency used for printing preferably is at least five kilohertz.

In an alternative embodiment, the print head temperature after receipt of the last print data for the print job is determined by using a diode disposed on the print head. In addition, the drop in print head temperature caused by ejecting the predetermined number of ink droplets is determined by using the diode disposed on the print head.

In another aspect, the invention is a method of cooling a print head of an ink jet printer. The method comprises the step of intermittently ejecting a predetermined number of ink droplets from nozzles of the print head at a frequency lower than a frequency used for printing.

Advantageously, the foregoing methods provide for efficient cooling of a print head after a print job.

This brief summary has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

Figure 1:
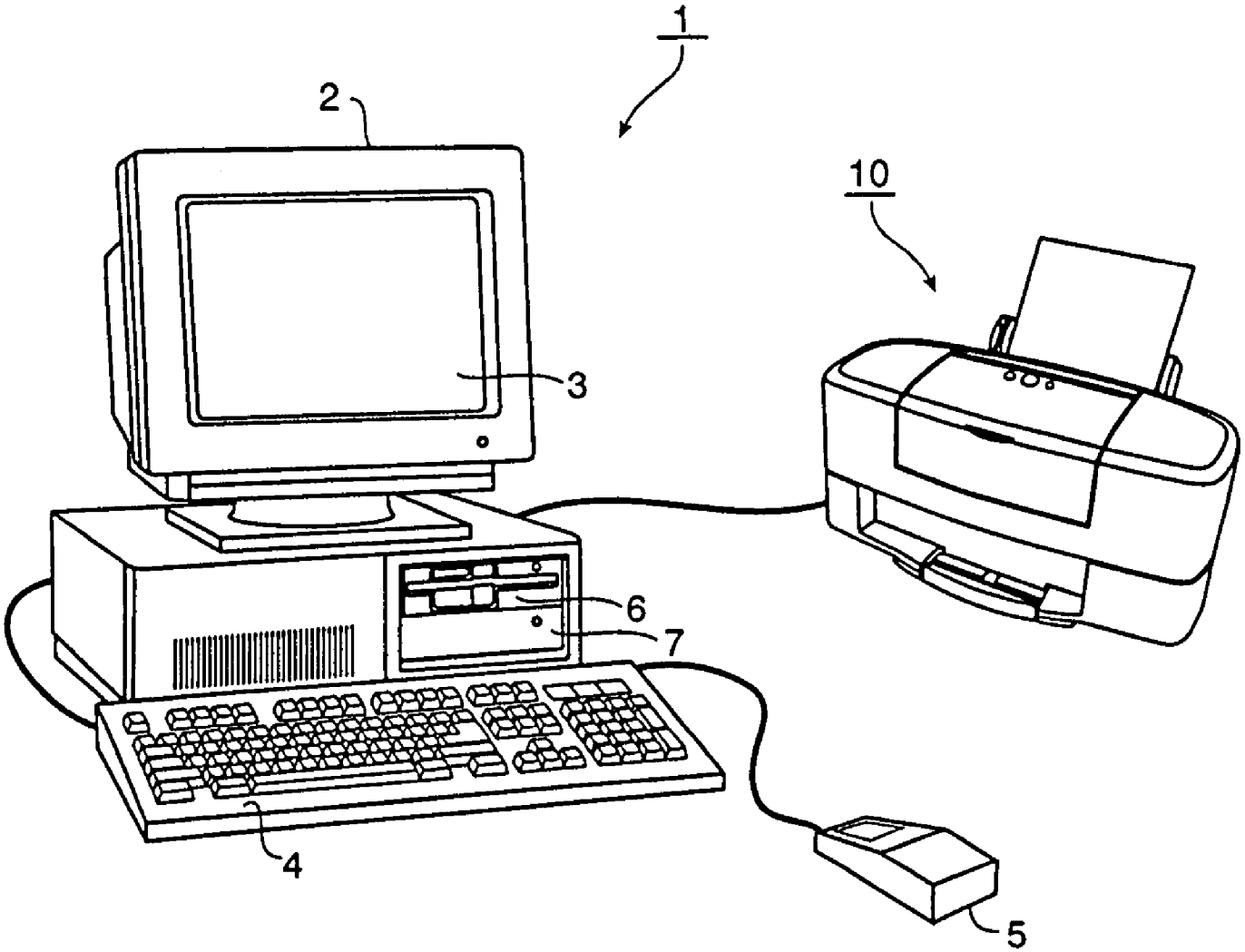
FIG. 1 shows a perspective view of computing equipment used in connection with the invention.

FIG. 1 is a view showing an outward appearance of computing equipment used in connection with the invention described herein. Computing equipment 1 includes host processor 2. Host processor 2 comprises a personal computer, preferably an IBM PC-compatible computer having a windowing environment, such as Microsoft® Windows95. Provided with computing equipment 1 are display screen 3 comprising a color monitor or the like, keyboard 4 for entering text data and user commands, and pointing device 5. Pointing device 5 preferably comprises a mouse for pointing to and for manipulating objects displayed on display screen 3.

Computing equipment 1 includes floppy disk interface 6 and a computer-readable memory medium, such as fixed disk 7. Floppy disk interface 6 provides a means whereby computing equipment 1 can access information, such as data files, application programs, etc., stored on floppy disks. A similar CD-ROM interface (not shown) may be provided with computing equipment 1 through which computing equipment 1 can access information stored on a CD-ROM.

Fixed disk 7 stores, among other things, application programs by which host processor 2 generates files, manipulates and stores those files on fixed disk 7, presents data in those files to an operator via display screen 3, and prints data in those files via printer 10. Fixed disk 7 also stores an operating system which, as noted above, is preferably a windowing operating system. Device drivers are also stored on fixed disk 7. At least one of the device drivers comprises a printer driver which provides a software interface to firmware in printer 10.

In preferred embodiments of the invention, printer 10 is a multi-head serial printer. Accordingly, although the invention described herein is not limited to use with such a printer, the invention will be described in the context of such a printer.

Figure 2:
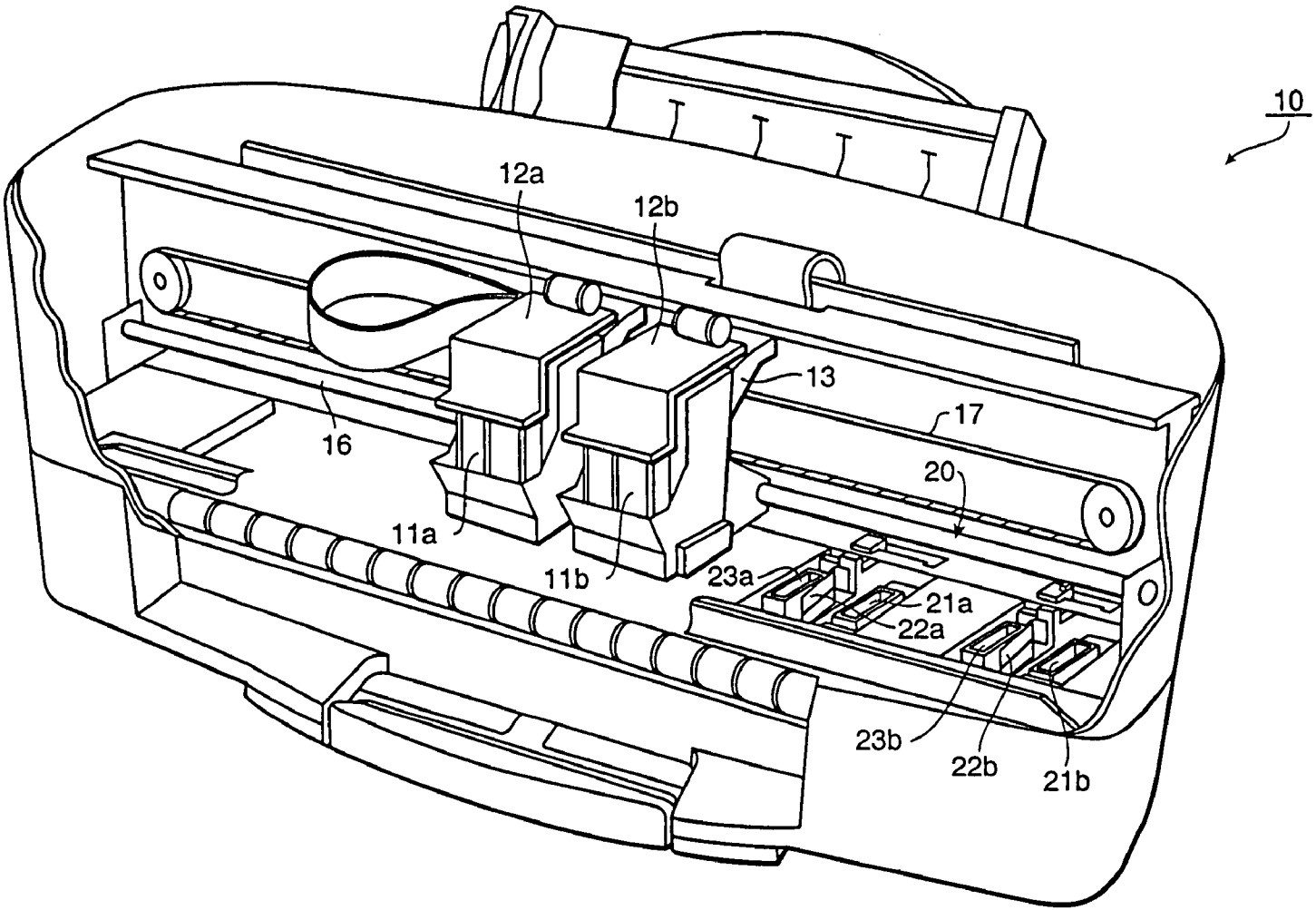
FIG. 2 is a front, cut-away perspective view of the printer shown in FIG. 1.

In this regard, FIG. 2 is a front, cut-away perspective view of printer 10. As shown in FIG. 2, printer 10 is a dual-cartridge printer which prints images using two print heads (i.e., one head per printer cartridge). Each print head has multiple ink jet nozzles which are used to print data upon a recording medium.

In more detail, printer cartridges 11*a* and lib each contain a print head and are held in receptacles 12*a* and 12*b*, respectively. Receptacles 12*a* and 12*b* in turn are parts of carriage 13. Carriage 13 is pulled laterally along bar 16 by belt 17, which is driven by a carriage motor (not shown). As carriage 13 moves, heating elements for the ink jet nozzles of the print heads are fired, thereby ejecting ink droplets in accordance with print data. Carriage 13 can move both left to right and right to left, providing for bi-directional printing as needed.

After print jobs, and in response to commands from host processor 2 or commands from internal printer control logic, carriage 13 moves to home position 20 in printer 10. Disposed at home position 20 so as to clean the print heads are ink suction devices 21*a* and 21*b*, wiper assemblies 22*a* and 22*b*, and ink ejection receptacles 23*a* and 23*b*.

Ink suction devices 21*a* and 21*b* preferably comprise a rotary pump and print head connection caps. The print head connection caps connect to the print heads of printer cartridges 11*a* and 11*b* during print head cleaning and at other times, such as when printer 10 is powered off, so as to protect the print heads.

Wiper assemblies 22*a* and 22*b* are used to wipe access ink from the print heads. Ink ejection receptacles 23*a* and 23*b* preferably receive ink purged from the print heads at various times so as to clear the ink jet nozzles. One situation when ink is purged from the print heads is discussed below.

Figure 3:
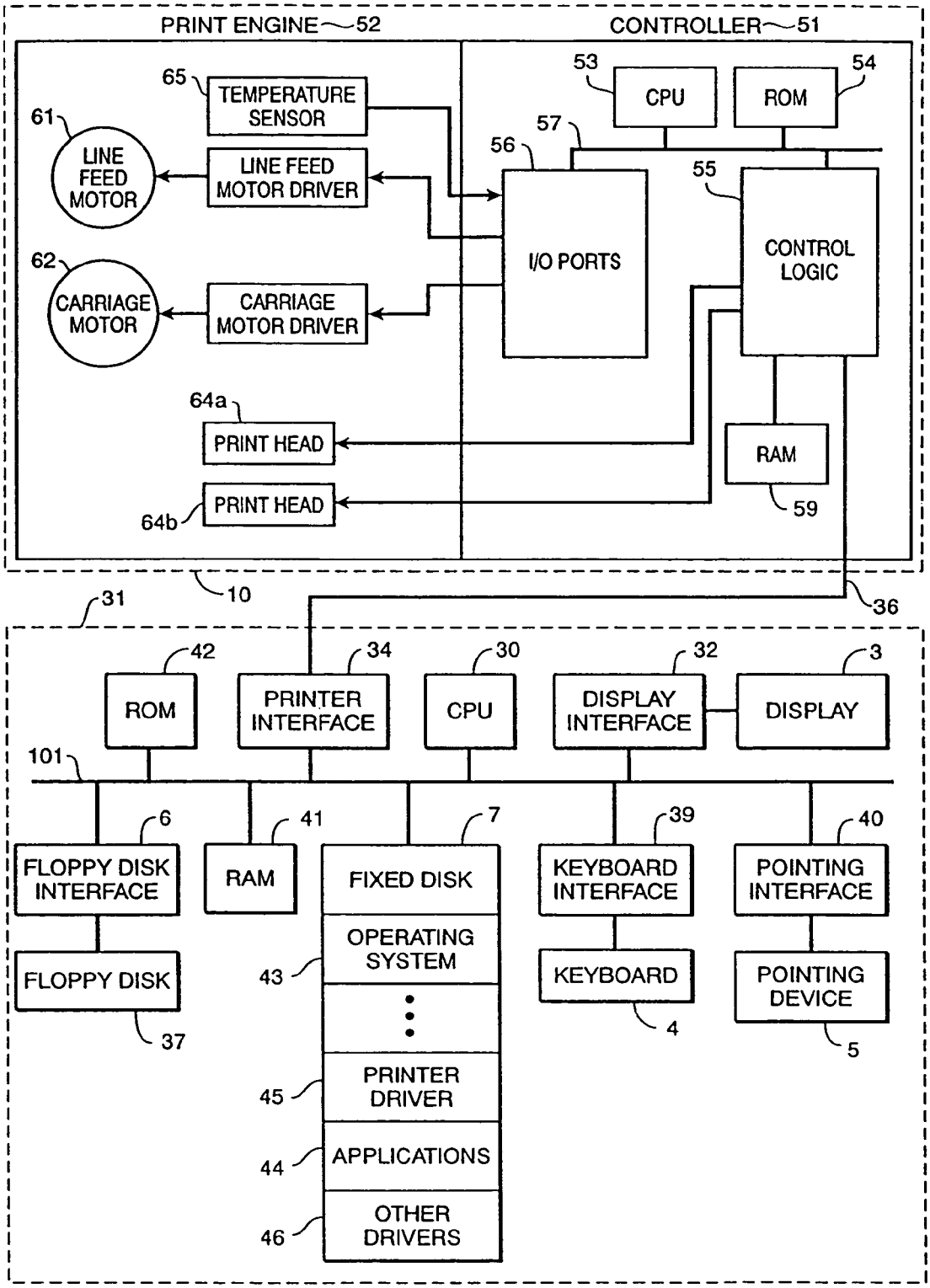
FIG. 3 is a block diagram showing the hardware configuration of a host processor interfaced to a printer that can utilize the invention.

FIG. 3 is a block diagram showing the hardware configuration of host processor 2 interfaced to printer 10 that can utilize the invention. In FIG. 3, host processor 2 includes a central processing unit 30 such as a programmable microprocessor interfaced to computer bus 31. Also coupled to computer bus 31 are display interface 32 for interfacing to display 3, printer interface 34 for interfacing to printer 10 through bi-directional communication line 36, floppy disk interface 6 for interfacing to floppy disk 37, keyboard interface 39 for interfacing to keyboard 4, and pointing device interface 40 for interfacing to pointing device 5. As explained in more detail below, additionally coupled to computer bus 31 are fixed disk 7, random access main memory (hereinafter "RAM") 41, and read only memory (hereinafter "ROM") 42.

Fixed disk 7 includes an operating system section for storing operating system 43, an applications section for storing application files 44, and a printer driver section for storing printer driver 45. Also included is an other drivers section for storing other drivers 46, such as a printer driver.

RAM 41 interfaces to computer bus 31 to provide CPU 30 with access to memory storage. In particular, when executing stored computer-executable process steps such as those associated with application files 44, CPU 30 loads those application instruction sequences from fixed disk 7 (or other storage media such as media accessed via a network or floppy disk interface 6) into RAM 41 and executes those stored program instruction sequences out of RAM 41. RAM 41 also provides for a print data buffer used by printer driver 45.

ROM 42 in host processor 2 stores invariant instruction sequences, such as start-up instruction sequences or basic input/output operating system (BIOS) sequences for operation of keyboard 4.

Printer 10 includes controller 51 and print engine 52. Controller 51 includes CPU 53 such as an 8-bit or a 16-bit microprocessor, ROM 54, control logic 55, and I/O ports unit 56 connected to bus 57. Connected to control logic 55 is RAM 59. Control logic 55 includes controllers for print image buffer storage in RAM 59 and for print engine 52, including controllers for line feed motor 61 and carriage motor 62. Control logic 55 also provides control signals and print data for print heads 64*a* and 64*b* of print engine 52, including heat pulse generation control signals, and receives data from temperature sensors (not shown) optionally disposed on print heads 64*a* and 64*b*. In addition, control logic 55 receives temperature data from ambient temperature sensor 65 through I/O ports unit 56. In the preferred embodiment, the temperature sensors are diodes.

Figure 4:
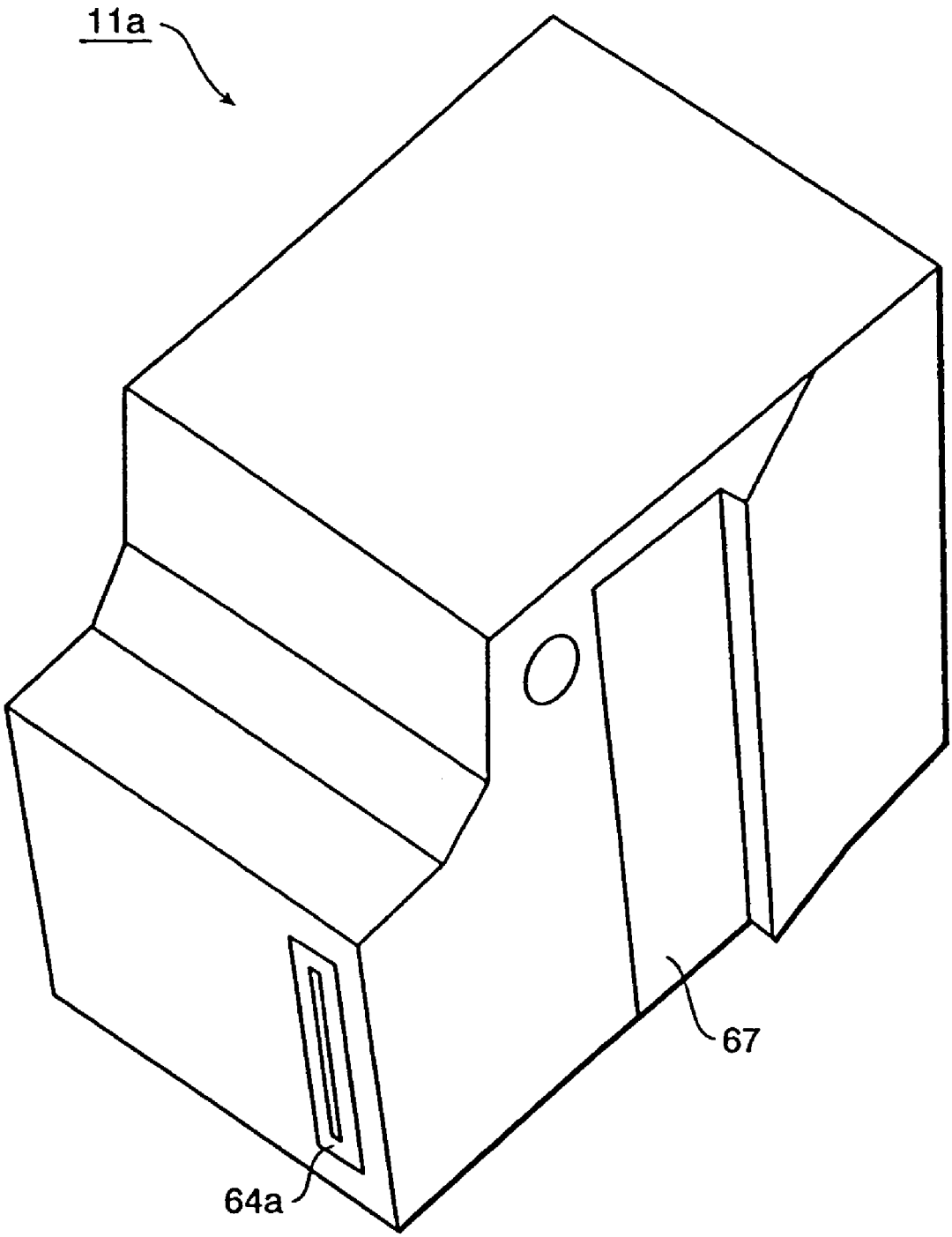
FIG. 4 is a perspective view of a printer cartridge with a print head that can utilize the invention.

FIG. 4 is a perspective view of printer cartridge 11*a* with one type of print head that can utilize the invention. As shown in FIG. 4, print head 64*a* and ink supply portion 67 of printer cartridge 11*a* are integrated. In other words, print head 64*a* and ink supply portion 67 are integral parts of printer cartridge 11*a*. However, the invention is equally applicable to printer cartridges that have separately removable and replaceable ink supply portions and print heads. In addition, printer cartridge 11*b* shown in FIG. 2 can be of the same type as printer cartridge 11*a* or of a different type.

Figure 5:
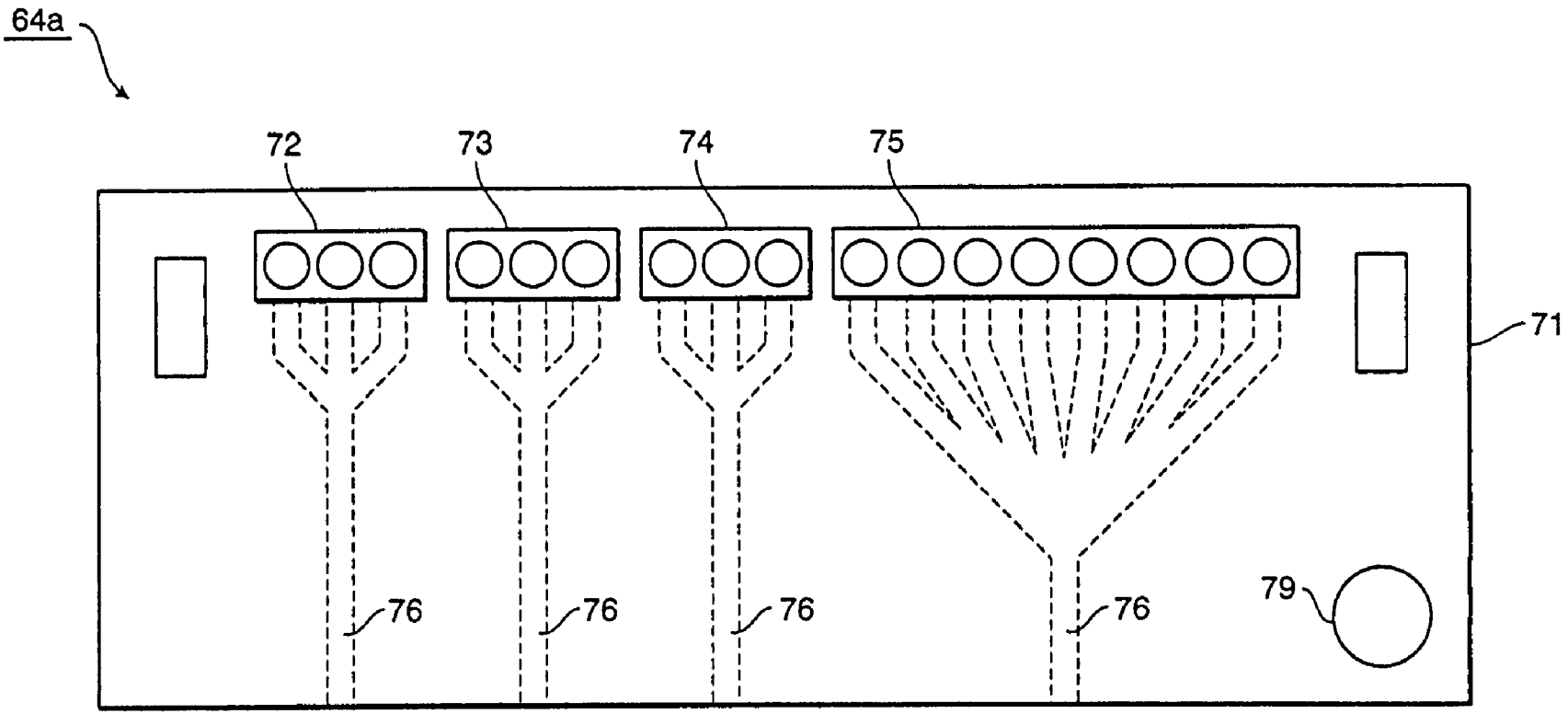
FIG. 5 is a schematic view of a print head of the type used with the printer cartridge of FIG. 4.

FIG. 5 is a schematic view of print head 64*a* that is part of printer cartridge 11*a*. Depicted in FIG. 5 is a heater board made from a silicon wafer that is disposed in print head 64*a*. Heater board 71 is of a type used in a color print head. Accordingly, heater board 71 has yellow nozzle group 72, magenta nozzle group 73, cyan nozzle group 64 and black nozzle group 75. In a typical print head, yellow, magenta and cyan nozzle groups 72 through 74 each have 24 nozzles; black nozzle group 75 has 64 nozzles. In FIG. 5, far fewer nozzles (represented by the small circles) are shown for the sake of clarity. It should be noted that the invention is equally applicable to print heads that have a different number and type of nozzles, such as a print head that has 128 black nozzles and no color nozzles.

Also shown in FIG. 5 are ink supply tubes 76. Each of these ink supply tubes feeds ink of the appropriate color to the nozzles. Before reaching the nozzles, ink supply tubes 76 branch so as to provide a separate ink supply tube branch for each nozzle. It should be noted that other arrangements of ink supply tubes are possible, and the present invention is equally applicable to print heads that utilize those arrangements.

Temperature sensor 79 is optionally provided for measuring a temperature of print head 64*a*. If this sensor is present, it preferably comprises a diode.

Small heating elements, depicted by the rectangles behind the nozzle groups in FIG. 5, are disposed behind the nozzles. While one rectangle is shown behind each nozzle group in FIG. 5, a separate heating element actually is disposed behind each nozzle. In operation, a meniscus forms at the boundaries of the ink with air in the nozzles. When print head 64*a* is commanded to eject an ink droplet from a nozzle, the heating element behind that nozzle fires. This firing of the heating element causes the ink to boil, forcing a small ink droplet to fly from the nozzle. The remaining ink in the nozzle re-forms a new meniscus, and the process is repeated as necessary.

In order for the above process of ejecting ink droplets to work properly, the nozzles must be unclogged and a meniscus must be able to form properly at each nozzle. Otherwise, control over the ink droplets degrades or becomes impossible.

As mentioned above, ink jet printers move their print head (or heads) to a home position after a print job is finished. At the home position, the print head is cleaned with the wiper assemblies and capped so as to keep ink from drying on the inside and the outside of the print head. However, if the print head is too hot when capped, heat from the print head and hot ink cannot readily dissipate, possibly resulting in a change of viscosity of the ink and/or drying of the ink. Ultimately, the confined hot ink can form unwanted deposits on outer portions of the nozzles (i.e., beyond where the meniscus should have formed) and on the print head, and these ink deposits can then thicken or dry. The thickened or dried ink deposits can interfere with proper operation of the print head. In particular, the ink deposits can either interfere with proper formation of a meniscus in a nozzle or can block a nozzle completely, resulting in poor print quality.

The invention addresses the foregoing problems by cooling the print head before capping. For the sake of brevity, the invention is described with reference to print head 64*a* of printer 10. However, as will be apparent to those skilled in the art, the invention is equally applicable to any type of print head used in an ink jet printer.

Briefly, the method for cooling the print head according to the invention includes the steps of determining an ambient temperature, determining a print head temperature, and waiting a predetermined time after receipt of the last print data for a print job. The method also includes the steps of ejecting a predetermined number of ink droplets from nozzles of the print head at a frequency lower than a frequency used for printing, determining a drop in print head temperature caused by ejecting the predetermined number of ink droplets, and repeating the steps of waiting a predetermined time and ejecting a predetermined number of ink droplets until the print head temperature falls below a predetermined threshold.

Figure 6:
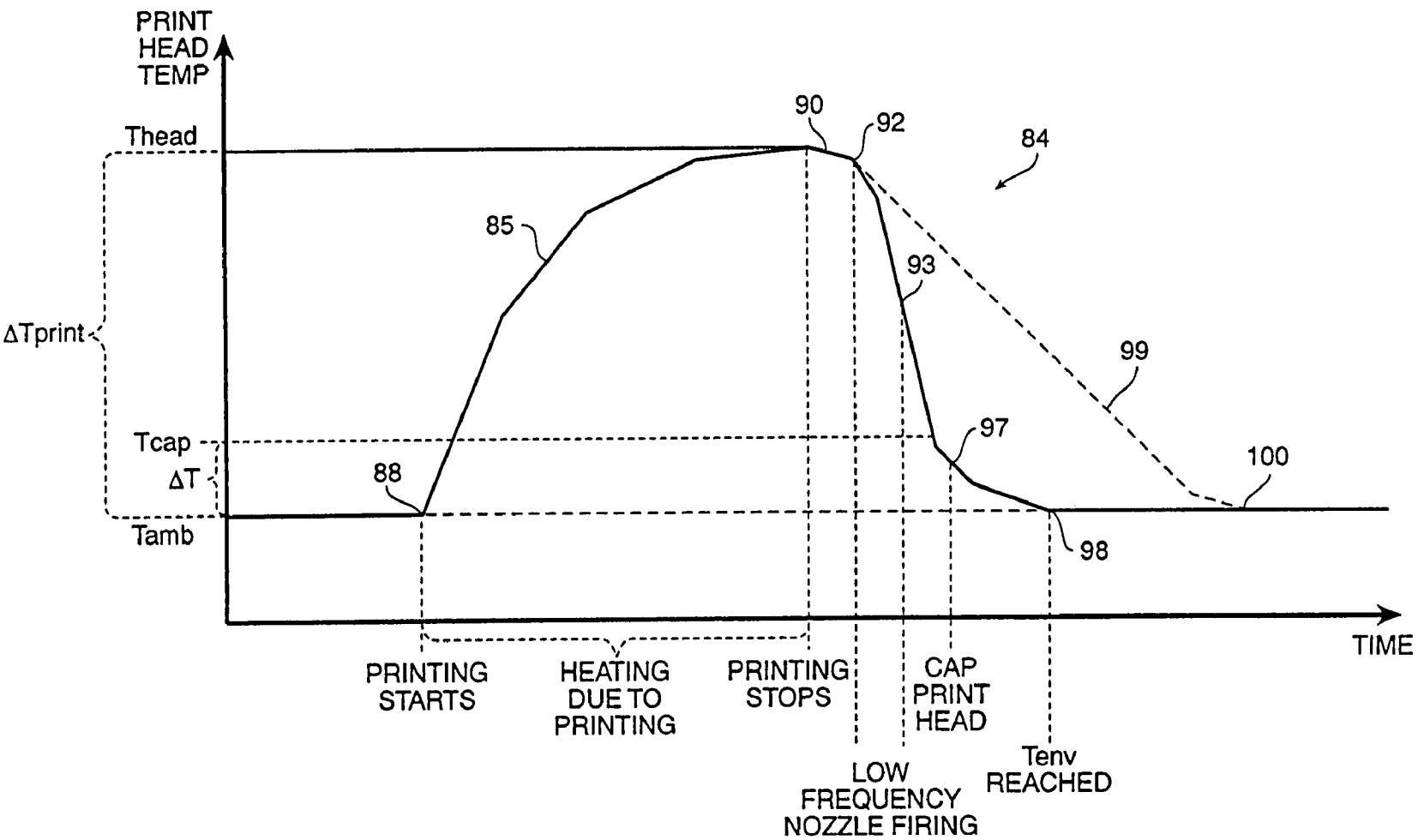
FIG. 6 is a graph of an example of cooling a print head according to the invention.

Shown in FIG. 6 is graph 84 of an example of cooling a print head according to the invention. The horizontal axis of graph 84 is time, and the vertical axis is print head temperature $T_{head}$. Solid line 85 shows the temperature of print head 64*a* according to the invention.

Before printing, the temperature of print head 64*a* is at $T_{amb}$, the ambient temperature. The ambient temperature preferably is determined by taking a measurement from temperature sensor 65 in printer 10. When printing starts at time 88, firing of the heating elements causes rise $\Delta T_{print}$ in print head temperature $T_{head}$.

In the preferred embodiment, $\Delta T_{print}$ is calculated using a mathematical model. According to this model, $\Delta T_{print}$ is equal to the sum of values for changes in print head temperature $\Delta T_n$ calculated at periodic intervals during the printing operation. The value for $\Delta T_n$ preferably are calculated every 50 milliseconds. In an alternative embodiment, $\Delta T_n$ is calculated once for the entire printing operation.

In the case of a color print head, $\Delta T_n$ can be calculated using the following equation:

$$\Delta T_n = (coeff1 * (\text{\# black droplets ejected})) + (coeff2 * (\text{\# color droplets ejected})) + (coeff3 * (\text{heater duty cycle})) + coeff4 * \Delta T_{n-1} + coeff5$$

where coeff1 is a heat-up coefficient based on the effect of the number of black ink droplets ejected, coeff2 is a heat-up coefficient based on the effect of the number of color droplets ejected, coeff3 is a heat-up coefficient based on the effect of the heater duty cycle (i.e., heater frequency), coeff4 is a heat diffusion coefficient, $\Delta T_{n-1}$ is the last calculated change in print head temperature, and coeff5 is a cool-down coefficient.

In more detail, coeff1 through coeff3 relate to the effect of firing the heating elements on print head temperature. Heat diffusion coefficient coeff4 relates to heat diffusion through the print head due to the difference between print head temperature $T_{head}$ and ambient temperature $T_{amb}$. The cool-down coefficient coeff5 represents cooling of print head 64*a* due to inactivity, including inactivity between the ejection of successive ink droplets, and the passage of cooler ink into print head 64*a* from ink supply tubes 76.

The values of coeff1 through coeff4 are typically positive, and the value of coeff4 is typically less than 1. The value of coeff5 is negative, representing cooling of the print head.

When calculating the first value of $\Delta T_n$ for $\Delta T_{print}$, $\Delta T_{n-1}$ has a value of zero, eliminating the heat diffusion coefficient coeff4 from the calculation. The heat diffusion coefficient is eliminated because the print head is at $T_{amb}$ the first time $\Delta T_n$ is calculated. Thus, there is no significant heat diffusion.

Of course, the actual coefficients and calculations used depend on the head/ink/resolution combination for the print head. For example, the calculation given above is suitable for a four-color print head, whereas an all-black print head would use a different calculation that excludes, for example, dependence on the number of color droplets ejected.

Alternatively, the rise in print head temperature $\Delta T_{print}$ can be determined by taking a reading from temperature sensor 79 on print head 64*a* of the actual print head temperature. However, the mathematical model is preferred because measurements taken from temperature sensor 79 can fluctuate widely, possibly resulting in an incorrect $T_{head}$ after printing.

Print head 64*a* is capped after printing so as to protect the print head. According to the invention, print head 64*a* is cooled down to $T_{cap}$ before capping. $T_{cap}$ is equal to the ambient temperature, as measured with temperature sensor 65, plus an acceptable difference $\Delta T_{cap}$, which in the present invention is 10° C. over $T_{amb}$ (i.e., $T_{cap}$ equals $T_{amb}$ plus $\Delta T_{cap}$, and $\Delta T_{cap}$ is 10° C.).

Print head 64*a* preferably is not cooled all the way down to $T_{amb}$ for at least two reason. First, cooling all the way down to $T_{amb}$ may take too much time for efficient operation. Second, print head operation actually can be improved if print head 64*a* is warmer than the ambient temperature, so long as the nozzles in print head 64*a* are not hot enough to cause the problems discussed above.

When printing stops at time 90 in FIG. 6, heating of print head 64*a* due to firing of the heating elements levels off, and print head 64*a* begins to cool down. Thus, the first step in cooling print head 64*a* according to the invention is to wait a predetermined amount of time, preferably between nine and twelve seconds. Thus, at time 92, print head 64*a* has cooled somewhat. However, in the example shown in FIG. 6, print head 64*a* has not cooled down to $T_{cap}$ after the predetermined wait.

In order to accelerate cooling of print head 64*a*, print head 64*a* at time 92 is commanded to eject a predetermine number of ink droplets from its nozzles at a frequency lower than a frequency used for printing. Print head 64*a* is positioned over ink ejection receptacle 23*a* for the ink ejection operation. In the preferred embodiment, the predetermined number of ink droplets that are ejected is thirty per nozzle, at a frequency of approximately two kilohertz. This frequency is lower than the frequency used for printing, which is at least five kilohertz.

Because so few droplets are ejected, firing the heating elements to eject the droplets does not cause a significant rise in print head temperature $T_{head}$. In fact, because of the low frequency of heating element firing and the motion of cooler ink into the nozzles from ink supply tubes 76, print head 64*a* is actually cooled down by ejecting the ink droplets.

Mathematically, in the equation given above for $\Delta T_n$, coeff5 is adjusted to account for the low frequency and the movement of cool ink into the print head. As a result, coeff5 dominates the equation, indicating that print head 64*a* is cooled. Thus, after the ink droplets have been ejected from print head 64*a*, print head temperature $T_{head}$ has fallen, as shown at time 93 in graph 84.

The above waiting and ejecting steps are repeated until print head temperature $T_{head}$ falls below $T_{cap}$. The drop in print head temperature $T_{head}$ is either computed mathematically, based on the above mathematical model for $\Delta T_n$ (with coeff5 adjusted accordingly), or by taking a reading from temperature sensor 79 on print head 64*a* of the actual print head temperature.

The calculated temperature approach is preferred over the actual temperature of the print head because temperature sensor 79 may not accurately measure the temperature of print head 64*a* around the nozzles, where the temperature matters most. Instead, temperature sensor 79 measures the temperature at a point removed from the nozzles. In addition, temperature measurements taken with temperature sensor 79 can fluctuate widely. This fluctuation is detrimental because it can result in a false low print head temperature reading. Such a false low can result in capping before print head 64*a* cools sufficiently, leading to the problems discussed above with respect to capping hot print heads.

At time 97, print head temperature $T_{head}$ has fallen below $T_{cap}$, so print head 64*a* is capped. After a time, if no other printing operations occur, print head temperature $T_{head}$ falls to $T_{amb}$, shown at time 98.

For comparison, line 99 in graph 84 shows print head temperature in a case that low frequency ejection of ink from the nozzles of print head 64a is not used. In that case, the print head temperature takes longer to fall to $T_{amb}$, at least partly because the print head is capped while it is still hot (i.e., just after printing stops at time 92). This capping traps the heat in the print head and prevents the heat from dissipating.

Figure 7:
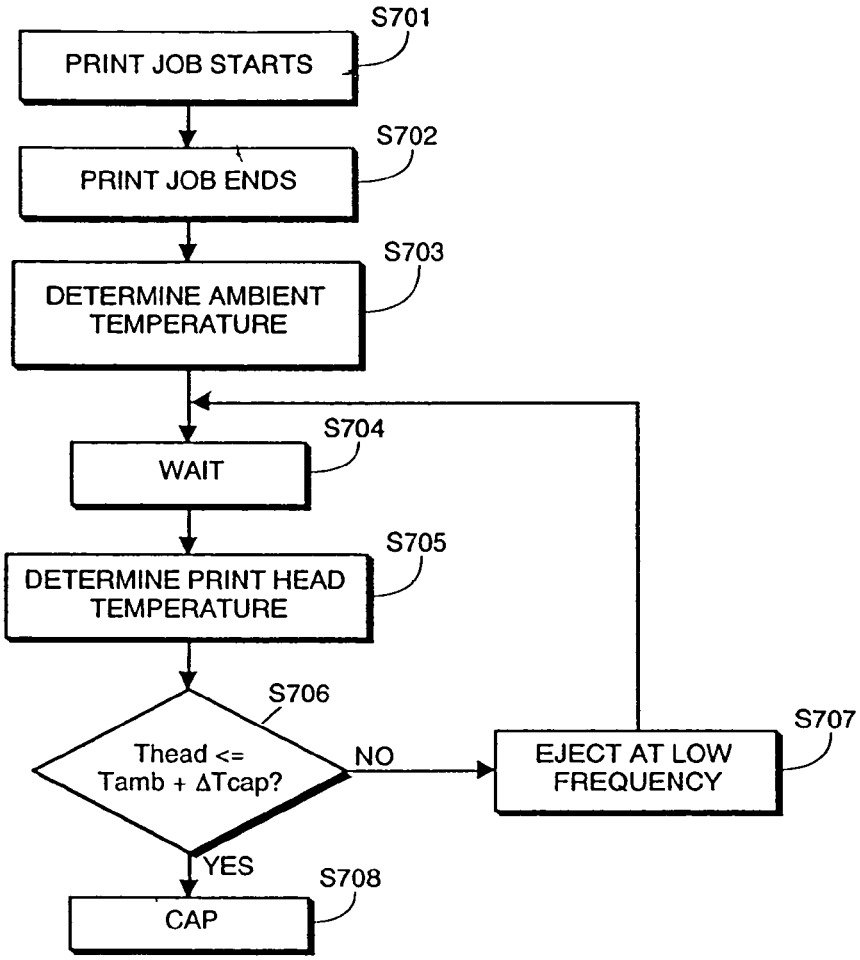
FIG. 7 is a flowchart for explaining cooling of a print head according to the invention.

FIG. 7 is a flowchart for explaining cooling of a print head according to the invention. In step S701, a print job starts. The print jobs causes print head 64*a* to heat up. In step S702, the print jobs ends. The ambient temperature is determined in steps S703, preferably by taking a reading of temperature sensor 65. The ambient temperature can be determined in advance of the print job or at any time during the print job. However, in the preferred embodiment, the ambient temperature is determined just after the print job, as shown.

In step S704, a wait of preferably nine to twelve seconds occurs. This waits allows the print head to cool somewhat without further action. In the case that the print job was short, this wait may allow for sufficient cooling of the print head.

The print head temperature $T_{head}$ is determined in step S705, either mathematically, as discussed above, or by taking a reading of temperature sensor 79. The mathematical approach is preferred. In step S706, it is determined if print head temperature $T_{head}$ is less than or equal to $T_{amb}$ plus $\Delta T_{cap}$.

If print head temperature $T_{head}$ has not fallen below or to $T_{amb}$ plus $\Delta T_{cap}$, then flow proceeds to step S707, where accelerated cooling is achieved by ejecting a predetermined number of ink droplets from print head 64*a* at a frequency lower than that used for printing. Then, flow returns to step S704 for another waiting period. The result of these steps is that ink droplets are ejected from print head 64*a* repeatedly at the lower frequency, with a pause between each repetition, until print head temperature $T_{head}$ falls below the threshold defined by $T_{amb}$ plus $\Delta T_{cap}$.

When it is determined in step S706 that $T_{head}$ has fallen to or below this threshold, flow proceeds to step S708, where print head 64*a* is capped.

It should be noted that other cleaning operations, such as wiping of print head 64*a* with wiper assembly 22*a*, can occur at any point throughout the above operation. In the preferred embodiment, head wiping occurs just after the print job and every time ink droplets are ejected from print head 64*a* into ink ejection receptacle 23*a*.

Figure 8:
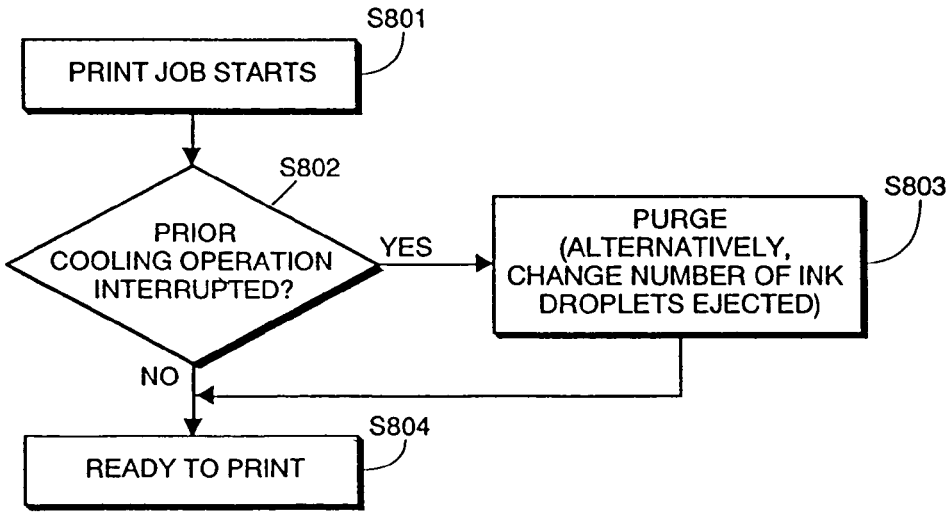
FIG. 8 is a flowchart for explaining excessive recovery for a print head in a case that a method according to the invention for cooling the print head is interrupted.

In actual operation, the above method can take some time. During that time, the cooling operation can be interrupted. For example, a user could switch printer 10 off before cooling is complete. In that case, at the start of the next print job, printer 10 should perform an excessive recovery operation to ensure that the nozzles of print head 64*a* are clear. FIG. 8 is a flowchart for explaining excessive recovery for a print head in this case.

Briefly, steps S801 through S804 correspond to obtaining a parameter corresponding to a print head temperature when the ink jet printer is down and performing a predetermined process (e.g., forced cooling of the print head) based on the parameter. In the preferred embodiment of the invention, steps S801 through S804 replace step S701 of FIG. 7.

In step S801, a print job starts after printer 10 has been, for example, turned off. In step S802, it is determined if a prior cooling operation was interrupted. This determination can be made by checking a non-volatile memory location in printer 10, by querying host processor 2 which can store the information on fixed disk 7, by sensing a position of print head 64*a* (e.g., if the print head is in the middle of the carriage, proper cooling was not performed), by checking if the print head is capped, etc. The determination can also be made by obtaining, when the ink jet printer is down (e.g., after soft power-off), a calculated print head temperature or an actual print head temperature measurement. Again, obtaining a calculated print head temperature is preferred over obtaining an actual print head temperature measurement. All of the above-described determinations are based on parameters the reflect whether the print head was cooled before an interruption in operation, and thus directly or indirectly correspond to print head temperature during the interruption (e.g., when the ink jet printer is down).

If the prior cooling operation was interrupted, flow proceeds to step S803, where ink is purged from print head 64*a* into ink ejection receptacle 23*a*. This purging operation comprises ejecting sufficient ink from print head 64*a* so as to clear the nozzles of any thickened or dried ink deposits. After purging, or if the prior cooling operation was not interrupted, flow proceeds to step S804, and printer 10 is ready to print.

In the case that printer 10 automatically ejects a number of ink droplets before a print job, step S803 can be replaced with a step of changing a number of ink droplets ejected before the print job. This alternative embodiment is shown parenthetically in step S803 of FIG. 8. In another embodiment, step S802 through S804 are performed at power-on for the ink jet printer, without waiting for a print job to start.

By virtue of the above operation, the invention provides for an efficient way to cool a print head of an ink jet printer, such as before capping.

It should be noted that the invention can be embodied in various forms. For example, the invention can be embodied in printer driver 45 on fixed disk 7, in ROM 54 of printer 10, and in control logic 55 of printer 10. As will be understood by those skilled in the art, these examples are not an exhaustive list of possible embodiments, and many other possible embodiments exist.

Accordingly, while the present invention is described above with respect to what is currently considered its preferred embodiments, it is to be understood that the invention is not limited to that described above. To the contrary, the invention is intended to cover various modifications and equivalent arrangements included within the spirit and scope of the appended claims.

What is claimed is:

1. A method of controlling a print operation of an ink jet printer, comprising the steps of:

obtaining a parameter corresponding to a print head temperature when the ink jet printer is down; and performing a predetermined process based on the parameter.

2. A method according to claim 1, wherein the parameter is obtained by a calculation, without using a measured actual temperature.

3. A method according to claim 1, wherein the parameter is obtained directly from a measured actual temperature.

4. A method according to claim 1, wherein the predetermined process occurs in a next print job performed by the ink jet printer.

5. A method according to claim 1, wherein the predetermined process occurs at a next power-on for the ink jet printer.

6. A method according to claim 1, wherein the predetermined process occurs at an end of a current print job.

7. A method according to claim 1, wherein the predetermined process is determined based on whether a print head is capped or not.

8. A method according to claim 1, wherein the predetermined process comprises changing a number of ink droplets ejected before a print job.

9. A method according to claim 1, wherein the predetermined process comprises purging ink from the print head.

10. An apparatus for controlling a print operation of an ink jet printer, comprising:

a memory including a region for storing executable process steps;

a processor for executing the executable process steps; and an interface between the processor and a print head of the ink jet printer that allows the processor to control firing of nozzles of the print head, wherein the executable process steps include steps of: (a) obtaining a parameter corresponding to a print head temperature when the ink jet printer is down; and (b) performing a predetermined process based on the parameter.

11. An apparatus according to claim 10, wherein the parameter is obtained by a calculation, without using a measured actual temperature.

12. An apparatus according to claim 10, wherein the parameter is obtained directly from a measured actual temperature.

13. An apparatus according to claim 10, wherein the predetermined process occurs in a next print job performed by the ink jet printer.

14. An apparatus according to claim 10, wherein the predetermined process occurs at a next power-on for the ink jet printer.

15. An apparatus according to claim 10, wherein the predetermined process occurs at an end of a current print job.

16. An apparatus according to claim 10, wherein the predetermined process is determined based on whether the print head is capped or not.

17. An apparatus according to claim 10, wherein the predetermined process comprises changing a number of ink droplets ejected before a print job.

18. An apparatus according to claim 10, wherein the predetermined process comprises purging ink from the print head.

19. Computer-executable process steps stored on a computer-readable medium, the computer executable process steps to control a print operation of an ink jet printer, the computer-executable process steps comprising:

code to obtain a parameter corresponding to a print head temperature when the ink jet printer is down; and code to perform a predetermined process based on the parameter.

20. Computer-executable process steps according to claim 19, wherein the parameter is obtained by a calculation, without using a measured actual temperature.

21. Computer-executable process steps according to claim 19, wherein the parameter is obtained directly from a measured actual temperature.

22. Computer-executable process steps according to claim 19, wherein the predetermined process occurs in a next print job performed by the ink jet printer.

23. Computer-executable process steps according to claim 19, wherein the predetermined process occurs at a next power-on for the ink jet printer.

24. Computer-executable process steps according to claim 19, wherein the predetermined process occurs at an end of a current print job.

25. Computer-executable process steps according to claim 19, wherein the predetermined process is determined based on whether a print head is capped or not.

26. Computer-executable process steps according to claim 19, wherein the predetermined process comprises changing a number of ink droplets ejected before a print job.

27. Computer-executable process steps according to claim 19, wherein the predetermined process comprises purging ink from the print head.

28. A computer-readable medium which stores computer-executable process steps, the computer-executable process steps to control a print operation of an ink jet printer, the computer-executable process steps comprising:

an obtaining step to obtain a parameter corresponding to a print head temperature when the ink jet printer is down; and a performing step to perform a predetermined process based on the parameter.

* * * * *